US007861880B2

(12) United States Patent
Britt et al.

(10) Patent No.: US 7,861,880 B2
(45) Date of Patent: Jan. 4, 2011

(54) PORTABLE AND/OR COLLAPSIBLE CONTAINERS HAVING PLIABLE SURFACES

(76) Inventors: Mark W. Britt, 109 Loon Trail, Monticello, GA (US) 31064; Steve Schneider, 1328 Arbor Gates, Atlanta, GA (US) 30324; Michael Socha, 1951 Shoreline Trace, Grayson, GA (US) 30017

( * ) Notice: Subject to any disclaimer, the term of this patent is extended or adjusted under 35 U.S.C. 154(b) by 553 days.

(21) Appl. No.: 11/770,566

(22) Filed: Jun. 28, 2007

(65) Prior Publication Data

US 2009/0001089 A1 Jan. 1, 2009

(51) Int. Cl.

| | |
|---|---|
| ***B65D 33/02*** | (2006.01) |
| ***B65D 6/00*** | (2006.01) |
| ***B65D 8/14*** | (2006.01) |
| ***B65D 30/10*** | (2006.01) |

(52) U.S. Cl. ..... 220/9.2; 220/4.28; 220/6; 220/9.1; 220/666

(58) Field of Classification Search ..... 220/4.28, 220/4.33, 6, 7, 9.1, 9.2, 9.3, 666
See application file for complete search history.

(56) References Cited

U.S. PATENT DOCUMENTS

| | | | | |
|---|---|---|---|---|
| 3,674,073 | A * | 7/1972 | Hendon | 383/18 |
| 4,373,849 | A * | 2/1983 | Robinson | 414/408 |
| 4,817,824 | A | 4/1989 | LaFleur et al. | |
| 5,431,878 | A | 7/1995 | Vason et al. | |
| 5,589,081 | A | 12/1996 | Harris | |
| 5,695,286 | A * | 12/1997 | Williamson et al. | 383/24 |
| 6,079,934 | A | 6/2000 | Beale | |
| 6,250,488 | B1 | 6/2001 | Narahara et al. | |
| 6,952,844 | B2 * | 10/2005 | Danaher | 5/414 |
| 7,073,676 | B1 * | 7/2006 | Town | 220/1.6 |
| 7,074,174 | B2 | 7/2006 | Lindgren et al. | |
| 7,261,467 | B2 * | 8/2007 | Kido et al. | 383/16 |
| 2002/0030334 | A1 | 3/2002 | Moore | |
| 2003/0216607 | A1 | 11/2003 | Lindgren et al. | |
| 2005/0011997 | A1 * | 1/2005 | Kalal | 248/99 |
| 2007/0127852 | A1 * | 6/2007 | Town et al. | 383/16 |

OTHER PUBLICATIONS

"What is the BullBag?," brochure by The BullBag,obtained from http://www.thebullbag.com, Copyright 2006.

* cited by examiner

*Primary Examiner*—Anthony Stashick
*Assistant Examiner*—Madison L Wright
(74) *Attorney, Agent, or Firm*—Withers & Keys, LLC

(57) ABSTRACT

Containers provide for portability and ease of handling by being constructed of pliable materials such as various polymers and having additional features. The containers may have biasing members such as tension poles to hold the containers in an upright and open top position and/or may have sleeves that can be engaged by a forklift for dumping of the container by a conventional forklift equipped garbage truck. The containers may include additional features such as loops along a top edge to allow grasping of the loops by a lift and loops along a bottom edge to allow dragging of the container such as onto a flatbed hauler. Additional features may include a top cover that can be pulled over the open top and secured such as by a fastener.

12 Claims, 5 Drawing Sheets

PORTABLE AND/OR COLLAPSIBLE CONTAINERS HAVING PLIABLE SURFACES

TECHNICAL FIELD

Embodiments relate to containers for holding debris and other materials. More particularly, embodiments relate to containers that include pliable surfaces and that are portable and/or collapsible to provide additional benefits to users.

BACKGROUND

Individuals and businesses often have a need for a container where garbage, debris, and other materials can be placed and later hauled away to a landfill or other appropriate location. Conventional metal garbage dumpsters allow the garbage, debris, and other materials to be hauled away. However, conventional metal garbage dumpsters are too unsightly and awkward to handle for a residence and for many businesses. They can only be moved by large equipment and may be expensive to purchase or rent. Therefore, conventional metal garbage dumpsters do not meet the needs of all situations.

Other approaches such as THE BULL BAG garbage bag offered by The Bull Bag, LLC include an upright garbage bag that requires a user to build the bag by installing braces typically made of plastic tubing and other bracing supports that brace the bag into the upright position. These garbage bags typically include only a set of loops at the top so that a truck with a lift may grasp the garbage bag by the set of loops. However, on the one hand, this may allow the garbage bag to be less awkward to handle than a conventional metal dumpster, but building and breaking down the bag requires additional time, effort, and some degree of construction skill on the part of the user. On top of that, this dump bag approach requires that a special truck service visit the site to pick up the garbage bag which may result in an additional cost that is unacceptable to the user.

SUMMARY

Embodiments disclosed herein may address one or more of these issues and others. For example, some embodiments may provide for a container that includes biasing members that bias opposing edges of the walls of the container so that the container can be folded and unfolded yet can maintain an upright position without the user installing bracing. As another example, some embodiments may provide for a container that includes dump sleeves to allow a conventional forklift to raise the container so that a conventional front end loader garbage truck or any garbage truck with a forklift may raise and dump the container. As other examples, some embodiments may provide both the biasing members and the dump sleeves and may also provide additional features such as loops for vertical pick-up and loops for sliding onto flatbeds.

One or more embodiments provide a container that includes a plurality of pliable wall panels and a pliable floor panel. Each pliable wall panel has a first edge attached to one of a plurality of edges of the floor panel, a second edge attached to an edge of an adjacent pliable wall panel, and a third edge attached to an edge of another adjacent pliable wall panel. The container further includes a plurality of biasing members with each of the plurality of biasing members being attached to a corresponding pliable wall panel of the plurality, the plurality of biasing members biasing opposing edges of the plurality of pliable wall panels to which the biasing members are attached such that the plurality of pliable wall panels define an open top though which materials may be placed into the container.

One or more embodiments provide a container that includes a plurality of pliable wall panels and a pliable floor panel. Each pliable wall panel has a first edge attached to one of a plurality of edges of the floor panel, has a second edge attached to an edge of an adjacent pliable wall panel, and has a third edge attached to an edge of another adjacent pliable wall panel. The container further includes a first sleeve that is attached to a first of the pliable wall panels, and the first sleeve has a longitudinal axis extending between the second edge and third edge of the first wall panel. The container also includes a second sleeve that is attached to a second of the pliable wall panels that is opposite the first of the pliable wall panels, and the second sleeve has a longitudinal axis extending between the second edge and third edge of the second wall panel.

One or more embodiments provide a method of handling debris that involves unfolding a container that includes a plurality of pliable wall panels and a pliable floor panel. Each pliable wall panel has a first edge attached to one of a plurality of edges of the floor panel, has a second edge attached to an edge of an adjacent pliable wall panel, and has a third edge attached to an edge of another adjacent pliable wall panel. The container includes a plurality of biasing members with each of the plurality of biasing members being attached to a corresponding pliable wall panel of the plurality. The plurality of biasing members bias opposing edges of the plurality of pliable wall panels to which the biasing members are attached such that the unfolded container maintains an upright and unfolded position and such that the plurality of pliable wall panels define an open top though which materials may be placed into the container. The method further involves placing debris through the open top and into an interior of the unfolded container.

DETAILED DESCRIPTION

Embodiments disclosed herein provide for portable, collapsible containers that may serve as dumpsters to collect garbage, debris, and other materials while providing ease of handling and emptying. Various embodiments provide containers that include biasing members to bias walls of the container into an open position while allowing the container to be folded into a collapsed position without disassembly of the container. Various embodiments provide containers that include sleeves that receive forks of a forklift such as that of a conventional front end loader garbage truck. Additional features may also be present in various embodiments such as lift loops, drag loops, cover panels, drains, and the like.

Figure 1:
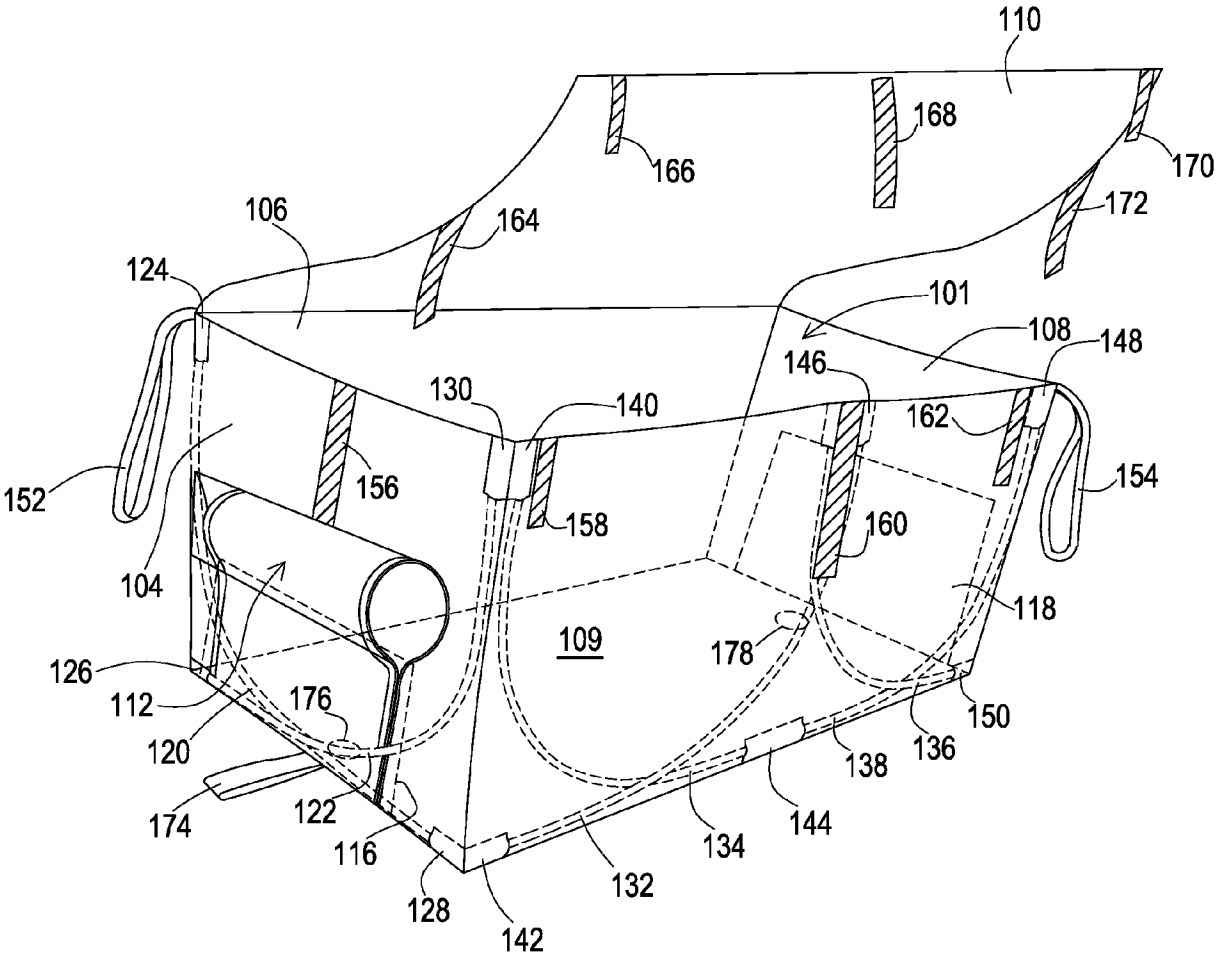
FIG. 1 shows a perspective view of an example of a container including biasing members and dumping sleeves according to various embodiments.
Figure 2:
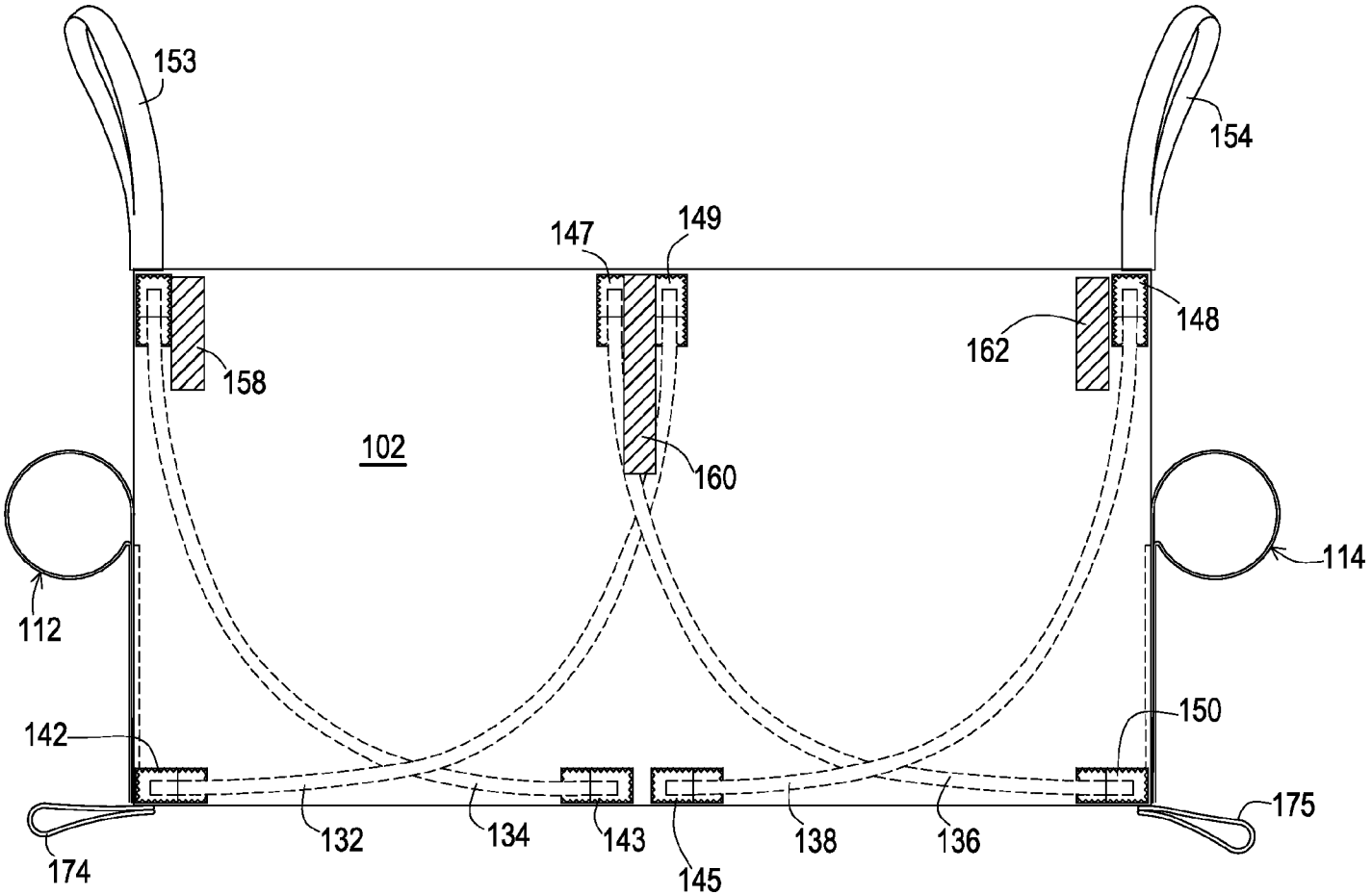
FIG. 2 shows a front view of an example of a container to further illustrate the biasing members and dump sleeves as well as drag loops and lift loops.
Figure 3:
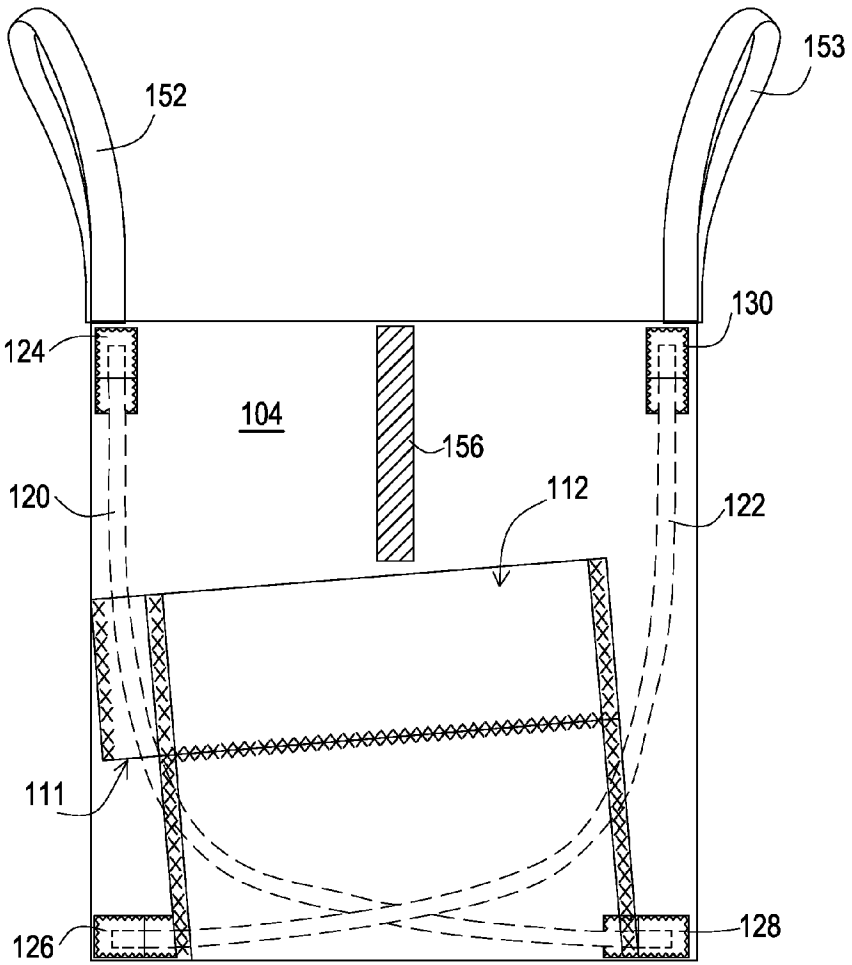
FIG. 3 shows a side view of an example of a container to further illustrate the biasing members and dump sleeves.

FIGS. 1-3 show one embodiment of a container that includes many features. As discussed below, other embodiments of a container may have a different configuration of features than those described in relation to FIGS. 1-3. Therefore, it should be appreciated that the embodiment of FIGS. 1-3 is provided merely for purposes of illustration and is not intended to be limiting.

The container 100 that is shown includes four pliable wall panels 102, 104, 106, and 108 as well as a pliable floor panel 109. In this example, the container 100 has rectangular panels and a rectangular opening 101. It will be appreciated that other shapes and sizes are also possible for the panels and the opening, such as triangular, pentagonal, and so forth.

In the example shown, each wall panel 102, 104, 106, and 108 and the floor panel 109 has four edges. Each vertical edge of the wall panels are attached to a vertical edge of an adjacent wall panel. Each bottom edge of the wall panels is attached to a corresponding edge of the floor panel 109. The corners of the container 100 where these vertical edges of the wall panels meet and where the bottom edges meet the floor panel edge may be constructed in various ways. For example, these corners may be formed by stitching with hems using any desired numbers of seams, ultrasonic welds, and so forth depending upon the strength requirements of the container 100. It has been found that for wall and floor panels constructed of materials such as woven polyethylene or woven polypropylene, hemmed corners using a high-strength polymer thread for the stitching while including a reinforcement woven polymer sheet sandwiching the adjoining panels and being connected with double seams is one example of a suitable approach. Woven polyethylene and woven polypropylene in the four to seven ounce weight range are examples of pliable but relatively strong materials that are suitable for constructing the wall and floor panels, but other weights and other pliable materials such as non-woven polymers, burlap, and so on are also applicable to the various embodiments.

Additionally, the materials used to construct the pliable wall and floor panels may have additional characteristics. For example, one or more of the pliable wall and floor panels may have an ultraviolet (UV) light protective coating such as those known in the art to reduce or prevent the destructive effects of ultraviolet light on the polymer or other material. Furthermore, one or more wall or floor panels, and particularly the floor panel, may either be constructed of a waterproof material to prevent leaks and leaching for situations where the container 100 have liquids placed within it. Waterproof material may include materials such as a non-woven polymer or another substance such as a woven polymer that has a coat of sealer such as a polyvinyl chloride (PVC) sealer applied to it.

As the embodiments may include pliable wall and floor panels, the container 100 also includes structural features to hold the container 100 upright and maintain the opening 101. In certain embodiments such as the one shown, biasing members are included to bias the container 100 into the upright position with the opening 101 maintained. In the specific example shown, the biasing members are tension poles such as those used to support tents. These tension poles are unbiased when straight and are held in a bent position as shown to bias opposing edges of the wall panels apart. As a result of this bias of the opposing edges of the wall panels, the wall panels maintain their shape, as a square or rectangle in this particular example, rather than collapsing. It will be appreciated that other forms of biasing members may also be used as an alternative to or in addition to the tension poles that are shown in order to maintain the shape of the wall panels and hence, maintain the upright position of the container 100. For example, spring-loaded rods may be included to bias opposing edges of the wall panels apart.

In this particular example, the tension poles are bent to form a 90 degree angle between directions that the ends of the tension poles are pointing with the ends of the tension pole being fixed in proximity to edges of the wall panel. This configuration results in a single tension pole creating tension between both sets of opposing edges of the wall panel. It will be appreciated that different configurations of tension poles may also be utilized. For example, a separate tension pole may be utilized for each edge of a given wall panel.

FIG. 1 shows the tension poles of both the side wall panel 104 and the front wall panel 102, while FIG. 2 shows the tension poles of the front wall panel 102 and FIG. 3 shows the tension poles of the side wall panel 104. Tension poles may also be included in the side wall panel 108 and the rear wall panel 106 to fully support the container 100 in the upright and open position but are omitted from FIGS. 1-3 to maintain clarity of those figures.

As can be seen in FIGS. 1 and 2, a first section of the front wall panel 102 includes a tension pole 132 that has a first end that is positioned within a pouch 149 of a pouch assembly 146 located on the inner side at a top edge and at the mid-point of the wall panel 102. The opposite end of the tension pole 132 resides in a pouch 142 located on the inner side at a corner where a bottom edge and left edge meet. Thus, the tension pole 132 is effectively attached to the front wall panel 102 by having the ends of the tension pole 132 confined to the pouches 142, 149. The first section of the front wall panel 102 also includes a tension pole 134 that has a first end that is positioned within a pouch 143 of a pouch assembly 144 located on the inner side at a bottom edge and at the mid-point of the wall panel 102. The opposite end of the tension pole resides in a pouch 140 located on the inner side at a corner where the top edge and left edge meet. Thus, this first section of the front wall panel 102 is being biased into its square shape to prevent the front wall panel 102 from collapsing so that the top edge forms a portion of the opening 101 of the container 100.

As can also be seen in FIGS. 1 and 2, a second section of the front wall panel 102 includes a tension pole 136 that has a first end that is positioned within a pouch 147 of the pouch assembly 146 located on the inner side at a top edge and at the mid-point of the wall panel 102. The opposite end of the tension pole 136 resides in a pouch 150 located on the inner side at a corner where the bottom edge and right edge meet. The second section of the front wall panel 102 also includes a tension pole 138 that has a first end that is positioned within a pouch 145 of the pouch assembly 144 located on the inner side at the bottom edge and at the mid-point of the wall panel 102. The opposite end of the tension pole 138 resides in a pouch 148 located on the inner side at a corner where the top edge and right edge meet. Thus, this second section of the front wall panel 102 is also being biased into its square shape to prevent the front wall panel 102 from collapsing so that the top edge forms a portion of the opening 101 of the container 100.

As can be seen in FIGS. 1 and 3, the side wall panel 104 includes a tension pole 120 that has a first end that is positioned within a pouch 124 located on the inner side at a corner where a top edge and rear edge meet. The opposite end of the tension pole 120 resides in a pouch 128 located on the inner side at a corner where the bottom edge and front edge meet. The side wall panel 104 also includes a tension pole 122 that has a first end that is positioned within a pouch 130 located on the inner side at a corner where the top edge and front edge meet. The opposite end of the tension pole 122 resides in a pouch 126 located on the inner side at a corner where the bottom edge and rear edge meet. Thus, this side wall panel 104 is being biased into its square shape to prevent the side wall panel 104 from collapsing so that the top edge forms a portion of the opening 101 of the container 100.

While the container 100 is shown with the pouches and tension poles located on the inner side of the pliable walls, it will be appreciated that other configurations are also possible. For example, one or more of the tension poles and the corresponding pouches may be located on the outer side of the pliable walls. In some examples, all the pouches and tension poles may be located on the outer side of the pliable walls.

In the unfolded state shown in FIGS. 1-3, the front and real walls 102, 106 take their fully extended position. The container 100 may be folded without disassembly by forcing the front and real wall panels 102, 106 to bend inward into the two sections along a vertical axis at the mid-point where pouch assemblies 144 and 146 are located. The floor panel 109 folds as necessary to allow the front and rear wall panels 102, 106 to bend inwardly until the side wall panels 104, 108 and both sections of the front and rear wall panels 102, 106 lie within the same plane and have a stacked configuration. In this folded state, the container 100 requires much less storage space and can be more easily transported. Once positioned at the desired location, the stacked configuration of wall panels may be unstacked by completely unbending the front and rear wall panels 102, 106 about the vertical axis at their mid-point and allowing the bias being applied by the tension poles to continue maintaining the shape of the wall panels to thereby maintain the container 100 in the upright and open position.

Figure 4C:
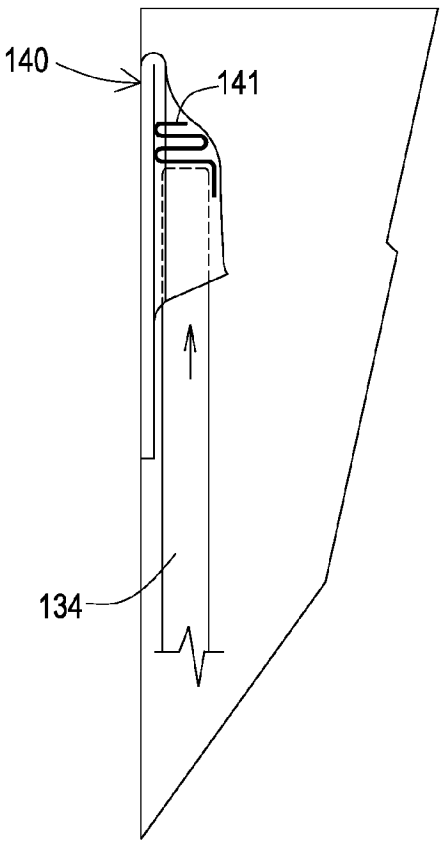
FIGS. 4A-4C show various views of one example of a tension pole pouch and related construction and reinforcement.
Figure 4B:
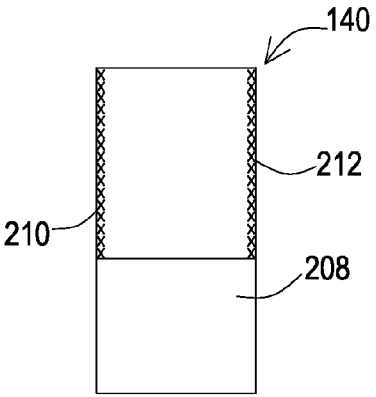
Figure 4A:
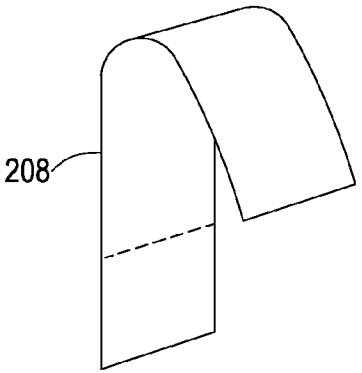

The pouches discussed above may be constructed in various ways. For example, as shown in FIGS. 4A-4C, a pouch 140 may be constructed as a single piece of pliable material 208, such as woven polyethylene or woven polypropylene, that is folded over at one end as shown in FIG. 4A, and then stitched along the outer sides 210, 212 as shown in FIG. 4B. By only stitching the sides 210, 212, the bottom edge is left unattached so that an end of a tension pole may be received into the pouch 140.

As shown in FIG. 4C the tension pole 134 is inserted into the pouch 140. In this particular example, additional material 141 is inserted into the pouch 140 prior to introduction of the tension pole 134. This additional material 141 strengthens the pouch 140 by preventing the end of the tension pole 134 from pressing through the folded end of the pouch 140 due to the bias forces applied by the end of the tension pole 134 to the pouch 140.

In the example shown, the tension poles can be readily inserted and removed from the pouches. This allows all tension poles to be removed such that the container 100 can be completely collapsed and folded as desired such as when storing the container 100 for a long period of time or when transporting. The tension poles may be re-inserted into the corresponding pouches to then allow the container 100 to regain and maintain its upright and open position.

Various embodiments of the container, such as embodiments like container 100 that use biasing members to maintain the upright position or embodiments that do not use such biasing members, may include dump sleeves 112, 114 as shown in FIGS. 1-3. These dump sleeves 112, 114 allow a forklift to raise and lower the container 100 such as when a conventional front end loader garbage truck is dumping the container. In the embodiment shown in FIGS. 1-3, the dump sleeves are included on the side wall panels 104 and 108 and are positioned so that the dimension between the dump sleeves 112 and 114 matches the width of the forks of a forklift of a conventional front end loader garbage truck. Furthermore, the height of the openings of the dump sleeves 112 and 114 match the height of the forks of the forklift of the conventional front end loader garbage truck when in the lowered position. Thus, the forks of the forklift may be easily inserted into the dump sleeves 112 and 114 by the forklift operator in the same manner that is done when lifting a conventional metal dumpster.

Figure 5C:
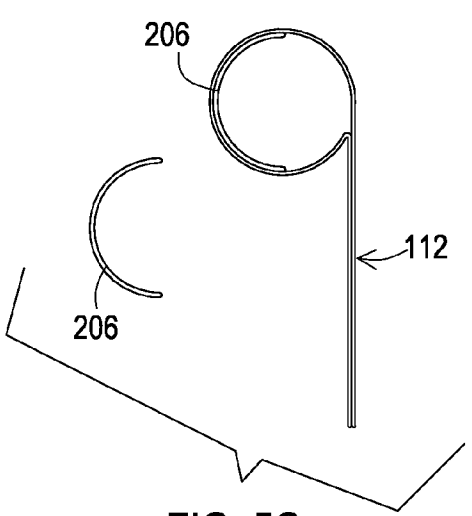
FIGS. 5A-C show various views of one example of a dump sleeve including related construction and reinforcement.
Figure 5B:
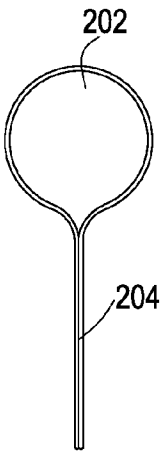
Figure 5A:
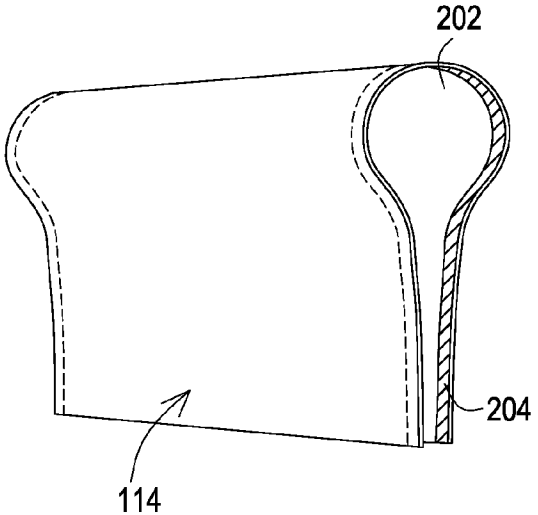

In the embodiment of FIGS. 1-3, the dump sleeves 112 and 114 are shaped as sleeves having a longitudinal axis of the opening running from the front to the rear of the side wall panels 104 and 108. The dump sleeves 112, 114 of this embodiment include a tubular region 202 that establishes the opening and also include a lower region 204 below the tubular region 202 where the material of the dump sleeves 112, 114 overlaps onto itself as can be seen in FIG. 5A. These lower regions are stitched together as can be seen in FIG. 5B and are then stitched to the side wall panels 104, 108.

The dump sleeves 112, 114 support the weight of the container 100 and all of the debris within the container upon a forklift raising the container 100 by the dump sleeves 112, 114. Therefore, in certain embodiments it may be desirable to further reinforce the attachment of the dump sleeves 112, 114 to the side wall panels 104, 108. In the embodiment shown, a reinforcement panel 116 is located on the inner side of the side wall panel 104 and a reinforcement panel 118 is located on the inner side of the side wall panel 108. The dump sleeves 112, 114 which are located on the outer side of the side wall panels 104, 108 are then stitched through the side wall panels 104, 108 and into the reinforcement panels 116, 118.

In certain embodiments such as the one that is shown, it may be desirable to assist the tendency of the container 100 to properly dump into the garbage truck upon being raised and tilted by the forklift. In the embodiment shown, the tendency of the container 100 to dump properly upon being raised is increased by providing dump sleeves 112, 114 with a longitudinal axis of the opening that is angled relative to the bottom edge of the side wall panels 104, 108 as is best seen in FIG. 3. Here, the end of the dump sleeve 112 that is closest to the rear edge of the side wall panel 104 is lower than the end of the dump sleeve 112 that is closest to the front edge of the side wall panel 104 where the forklift is inserted. Thus upon introduction of the forks into the dump sleeves 112, 114, the container 100 is tilted forward to assist in properly dumping the contents of the container 100 when being raised and tilted by the forklift.

Also best seen in FIG. 3, in certain embodiments an end cap 111 may be stitched onto or otherwise attached to the end of the dump sleeve 112, 114 that is closest to the rear edge of the side wall panel 104, 108. This end cap 111 receives the tip of the forks of the forklift to prevent the container 100 from sliding farther than necessary onto the forks of the forklift to thereby also assist in the proper dumping of the container 100.

The dump sleeves 112, 114 may be made of various materials. Some examples include woven polyethylene or woven polypropylene that may also be used for the wall and floor panels of the container 100. Where the materials used for the dump sleeves 112, 114 are pliable, it may be desirable to include a circular or semi-circular stiffener 206 as shown in FIG. 5C that is installed inside the tubular regions 202 to hold the tubular regions 202 in the open position. Maintaining the tubular regions 202 in the open position ensures that the forks of the forklift can be easily inserted. Examples of materials used for the stiffener 206 include hard but somewhat flexible plastic, flexible metal, and so forth. It may be desirable for the stiffener 206 to have some flexibility so that the sleeve deforms slightly upon the container 100 being lifted.

Various embodiments of the container 100 may include additional features including those shown for container 100 of FIGS. 1-3. For example, lift loops 152, 154 may be included for embodiments that include the biasing members and/or the dump sleeves to provide an additional manner of lifting the container 100. While two lift loops 152, 154 are shown in some of the figures for purposes of clarity, it will be appreciated that additional lift loops may be included such as a lift loop at each corner along the top edge of the container 100, such as additional lift loop 153 of FIGS. 2 and 3. The lift loops may be made of various materials such as a soft polymer webbing and the like. The lift loops may extend down the corners by a substantial amount, for example 18 inches, and be stitched into the seams used to create the corners so as to reinforce the lift loop and its attachment to the container 100.

Another additional feature that may be included for certain embodiments is one or more drag loops 174, 175. As shown, the drag loops 174, 175 are sewn to the junction of the bottom edge of the side wall panels 104, 108 and the edge of the floor panel 109. The drag loops 174, 175 may be used to drag the container 100 from one location to another, such as onto a flat bed truck that may haul away the container 100. The drag loops may be constructed of various materials such as the same materials used to construct the lift loops 152, 154.

Another additional feature that may be included for certain embodiments is one or more drains holes and corresponding grommets 176, 178. These drains may allow the container 100 to be emptied of certain materials such as liquids and granular materials that are contained within it while the grommets may be included to define the hole and prevent the pliable material from tearing or otherwise coming apart. For embodiments where the container 100 is expected to hold liquids without leaking or leaching, the drain holes 176, 178 may be omitted or plugged.

Another additional feature that may be included for certain embodiments is a top cover 110. This top cover may be attached to the container along a top edge of one of the wall panels, such as the rear wall panel 106 as shown. The top cover may be constructed of a pliable material such as the same material used to construct the wall panels or floor panel 109. Fasteners may be used to hold the top cover 110 down to close the opening 101 of the container 100. One example of a fastener is a hook and loop fastener as shown, where the wall panels include one side 156, 158, 160, 162 of the hook and loop fastener while the top cover 110 includes the mating side 164, 166, 168, 170, 172 of the hook and loop fastener. As another example, a zipper may be used to hold the top cover 110 in the closed position where one side of the zipper track is included along the top edge of the pliable wall panels while the other side of the zipper track is included along the outer edges of the top cover 110 such that the outer edges of the top cover 110 are held to the top edge of the wall panels upon closing the zipper.

An example of dimensions of a rectangular container such as the one shown will now be discussed for the purpose of illustration. This example is not intended to be limiting but merely provides dimensions of one example of a container that can be dumped by a conventional garbage truck. It will be appreciated that many variations in the dimensions and shapes of embodiments of the container may be applicable to a given situation. In this example, the width of the unfolded container is about 72 inches while the height is about 38 inches and the depth is about 36 inches. The folded container has dimensions of about 4 inches by 38 inches by 36 inches.

In this example, the pouches are approximately 5 inches tall, with a width of about 2.5 inches and with the flap forming the enclosure of the pouch being about 3 inches in length so that about 3 inches of the tension pole end is within the pouch. The opening of the dump sleeves is about 9.5 inches in diameter. The height of the top edge of the dump sleeve at the front is about 23.75 inches while the height of the top edge of the dump sleeve at the rear is about 21.25 inches.

As discussed above, various embodiments of containers provide features such as biasing members and/or dump sleeves that may increase the level of convenience and usability of the container. While embodiments have been particularly shown and described, it will be understood by those skilled in the art that various other changes in the form and details may be made therein without departing from the spirit and scope of the invention.

What is claimed is:

1. A container comprising:

a plurality of pliable wall panels and a pliable floor panel, wherein the pliable wall panels and the pliable floor panel are constructed of a polymer, each pliable wall panel having a first edge attached to one of a plurality of edges of the floor panel, each pliable wall panel having a second edge attached to an edge of an adjacent pliable wall panel and having a third edge attached to an edge of another adjacent pliable wall panel;

a first sleeve that is attached to a first of the pliable wall panels, the first sleeve having a longitudinal axis extending between the second edge and third edge of the first wall panel;

a second sleeve that is attached to a second of the pliable wall panels that is opposite the first of the pliable wall panels, the second sleeve having a longitudinal axis extending between the second edge and third edge of the second wall panel, wherein the first and second sleeves are attached to the first and second pliable wall panels so that the longitudinal axis of the first and second sleeves is not parallel to the first edge of the first and second pliable wall panels; and end caps on first ends of the first and second sleeves.

2. The container of claim 1, wherein the polymer is a woven polyethylene.

3. The container of claim 1, further comprising a pliable cover panel attached to a top edge of at least one pliable wall panel that is opposite the edge attached to the pliable floor panel.

4. The container of claim 1, further comprising a plurality of loops extending from a top edge of the plurality of pliable wall panels at a point in proximity to attachment of the edges of the plurality of pliable wall panels to the adjacent pliable wall panels of the plurality.

5. The container of claim 1, further comprising a loop extending from an edge attached to the pliable floor panel of at least one of the plurality of pliable wall panels.

6. A container comprising:

a plurality of pliable wall panels and a pliable floor panel, each pliable wall panel having a first edge attached to one of a plurality of edges of the floor panel, each pliable wall panel having a second edge attached to an edge of an adjacent pliable wall panel and having a third edge attached to an edge of another adjacent pliable wall panel;

a first sleeve that is attached to a first of the pliable wall panels, the first sleeve having a longitudinal axis extending between the second edge and third edge of the first wall panel;

a second sleeve that is attached to a second of the pliable wall panels that is opposite the first of the pliable wall panels, the second sleeve having a longitudinal axis extending between the second edge and third edge of the second wall panel; and end caps on first ends of the first and second sleeves.

7. The container of claim 6, wherein the pliable wall panels and the pliable floor panel are constructed of a polymer.

8. The container of claim 7, wherein the polymer is a woven polyethylene.

9. The container of claim 6, further comprising a pliable cover panel attached to a top edge of at least one pliable wall panel that is opposite the edge attached to the pliable floor panel.

10. The container of claim 6, further comprising a plurality of loops extending from a top edge of the plurality of pliable wall panels at a point in proximity to attachment of the edges of the plurality of pliable wall panels to the adjacent pliable wall panels of the plurality.

11. The container of claim 6, further comprising a loop extending from an edge attached to the pliable floor panel of at least one of the plurality of pliable wall panels.

12. The container of claim 6, wherein the first and second sleeves are attached to the first and second pliable wall panels so that the longitudinal axis of the first and second sleeves is not parallel to the first edge of the first and second pliable wall panels.

* * * * *